US010220534B2

(12) United States Patent
Chen

(10) Patent No.: US 10,220,534 B2
(45) Date of Patent: Mar. 5, 2019

(54) PAPER CORNER PROTECTOR CUTTER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 323 days.

(21) Appl. No.: 14/997,853

(22) Filed: Jan. 18, 2016

(65) Prior Publication Data

US 2017/0203454 A1 Jul. 20, 2017

(51) Int. Cl.

| | |
|---|---|
| ***B26D 1/08*** | (2006.01) |
| ***B26D 3/16*** | (2006.01) |
| ***B26D 7/26*** | (2006.01) |
| ***B26D 5/10*** | (2006.01) |

(52) U.S. Cl.

CPC ..... *B26D 1/085* (2013.01); *B26D 3/16* (2013.01); *B26D 5/10* (2013.01); *B26D 7/2614* (2013.01); *Y10T 83/8748* (2015.04); *Y10T 83/884* (2015.04); *Y10T 83/8845* (2015.04); *Y10T 83/8853* (2015.04)

(58) Field of Classification Search

CPC ..... B23D 17/08; B23D 15/06; B23D 15/08; B23D 15/12; B23D 23/00–23/04; B23D 2023/005; B23D 21/06; Y10T 83/8845; Y10T 83/8748; Y10T 83/8853; Y10T 83/884; B26D 5/10

USPC ..... 72/326, 332

See application file for complete search history.

(56) References Cited

U.S. PATENT DOCUMENTS

| | | | | | |
|---|---|---|---|---|---|
| 42,003 | A | * | 3/1864 | Lamplugh | B23D 17/08 83/605 |
| 276,265 | A | * | 4/1883 | Meyer | B23D 47/04 83/463 |
| 355,415 | A | * | 1/1887 | Schaffer | B02C 1/14 241/270 |
| 693,404 | A | * | 2/1902 | Kimball | B26D 1/08 83/643 |
| 1,146,089 | A | * | 7/1915 | Neely | B26D 5/08 83/625 |
| 1,414,128 | A | * | 4/1922 | Heilman | B26D 1/095 83/438 |
| 1,439,556 | A | * | 12/1922 | Kirsch | E04D 15/02 83/167 |
| 1,513,640 | A | * | 10/1924 | Shaw | B28D 1/223 125/23.01 |
| 1,517,625 | A | * | 12/1924 | Glasser | B43M 7/007 83/588 |

(Continued)

FOREIGN PATENT DOCUMENTS

CN 206105009 U * 4/2017 ..... B23D 15/14

*Primary Examiner* — Laura M Lee

(74) *Attorney, Agent, or Firm* — Ming Chow; Sinorica, LLC

(57) ABSTRACT

A paper corner protector cutter includes a base. The base is provided with a frame. The frame is pivotally connected with an operation rod. The operation rod is able to link a blade holder. The blade holder is provided with two blades. Two stop plates are disposed at two sides of the frame, enabling the blade holder to be located between the stop plates. Two stop plates are provided between the stop plates corresponding to the blade holder. The paper corner protector cutter can be assembled and positioned with ease by using a plate-type structure. The required time to assemble or disassemble the paper corner protector cutter can be decreased greatly to enhance the economic benefits.

10 Claims, 12 Drawing Sheets

(56) References Cited

U.S. PATENT DOCUMENTS 1,524,823 A * 2/1925 Henesey ..... B23D 35/005 83/624
1,717,043 A * 6/1929 Kistler ..... B23D 29/023 30/251
1,721,182 A * 7/1929 Jensen ..... B23D 21/00 83/603
1,731,413 A * 10/1929 Glasser ..... B43M 7/007 414/412
1,805,163 A * 5/1931 Buckner ..... C14B 5/04 83/642
1,987,455 A * 1/1935 Washburn ..... B28D 1/223 83/515
1,998,556 A * 4/1935 Polly ..... B23D 17/08 269/296
2,695,059 A * 11/1954 Ernst ..... B23D 21/00 83/199
2,814,346 A * 11/1957 Jauss ..... B26F 1/14 83/620
3,065,657 A * 11/1962 Thompson ..... B23D 21/02 29/33 R
3,126,781 A * 3/1964 Hall ..... B23D 21/00 83/628
3,269,239 A * 8/1966 Dixon ..... A01G 2/30 83/140
3,391,591 A * 7/1968 Funke ..... B23D 15/00 83/197
3,452,632 A * 7/1969 Brolund ..... B23D 35/008 100/224
3,584,529 A * 6/1971 Wallace ..... B23D 21/00 83/457
3,771,401 A * 11/1973 Jasinski ..... B23D 23/00 83/453
3,866,522 A * 2/1975 Oswalt, Jr. ..... B21D 22/00 72/324
3,886,927 A * 6/1975 Chattin ..... B28D 1/223 125/23.01
4,457,197 A * 7/1984 Wepner ..... B23D 31/00 83/197
4,781,093 A * 11/1988 Guenard ..... B26D 3/003 83/176
5,934,166 A * 8/1999 Herlihy ..... B23D 17/08 83/605
6,138,657 A * 10/2000 Richard ..... B28D 1/223 125/16.03
6,997,092 B2 * 2/2006 Lin ..... B26F 1/40 83/378
7,461,457 B2 * 12/2008 Liverman ..... B26D 1/08 30/180
8,020,478 B2 * 9/2011 Cheng ..... B23D 23/00 83/452
8,122,805 B2 * 2/2012 Liu ..... B26D 5/10 30/218
2004/0089126 A1 * 5/2004 McLean ..... B26D 1/08 83/605
2009/0151532 A1 * 6/2009 Liu ..... B26D 5/10 83/618
2010/0089217 A1 * 4/2010 Cheng ..... B23D 23/00 83/631

* cited by examiner

PAPER CORNER PROTECTOR CUTTER

BACKGROUND OF THE INVENTION

1. Field of the Invention

The present invention relates to a packing material cutting machine, and more particularly to a paper corner protector cutter.

2. Description of the Prior Art

A conventional paper corner protector cutter comprises a base. The base is provided with two circular rods. A blade holder is provided between the two circular rods for insertion of a blade. The blade holder is pivotally connected with an operation rod, such that the operation rod can bring the blade holder to slide between the circular rods and the blade is used for cutting.

For the blade holder to slide smoothly between the circular rods, the paper corner protector cutter needs a strict requirement for accuracy. When the paper corner protector cutter is assembled or the blade is replaced, it is necessary to adjust the position again and again for the blade holder to slide smoothly between the circular rods. Therefore, it consumes much time and for assembly of the paper corner protector cutter and replacement of the blade to increase the cost. Accordingly, the inventor of the present invention has devoted himself based on his many years of practical experiences to solve these problems.

SUMMARY OF THE INVENTION

The primary object of the present invention is to provide a paper corner protector cutter. The paper corner protector cutter can be assembled and positioned with ease by using a plate-type structure. The required time to assemble or disassemble the paper corner protector cutter can be decreased greatly to enhance the economic benefits.

In order to achieve the aforesaid object, the paper corner protector cutter of the present invention comprises a base, a frame, a handle, a blade holder, at least one blade, two stop plates, and at least one chopping board. The frame is disposed on the base. The frame comprises a first erect frame and a second erect frame which are spaced. The second erect frame is pivotally connected with an operation rod. The operation rod is pivotally connected with a drive shaft. The handle is pivotally connected to the first erect frame. The handle is pivotally provided with a connecting rod. The connecting rod is pivotally connected to the operation rod. The blade holder is disposed between the first erect frame and the second erect frame. The blade holder comprises a first plate and a second plate. A top end of each of the first plate and the second plate is formed with an opening. A drive block is provided in the openings of the first plate and the second plate. The drive block has a through hole. The drive shaft is inserted through the through hole of the drive block. The blade holder is connected with the drive block through the opening. The operation rod is pivotally connected with the drive block through the drive shaft. A bottom end of the first plate is formed with a first reverse V-shaped recess. A bottom end of the second plate is formed with a second reverse V-shaped recess. The blade holder has a blade room formed between the first reverse V-shaped recess and the second reverse V-shaped recess. The blade is inserted in the blade room. The two stop plates are disposed at two sides of the frame, enabling the blade holder to be located between the stop plates. The stop plates each have a first reverse V-shaped opening corresponding to the blade holder. The chopping board is fixedly connected to the stop plates.

Through the plate-type structure of the frame, the blade holder, and the stop plate, the paper corner protector cutter of the present invention can be assembled and positioned with ease. The required time to assemble or disassemble the paper corner protector cutter can be decreased greatly to enhance the economic benefits.

DETAILED DESCRIPTION OF THE PREFERRED EMBODIMENTS

Embodiments of the present invention will now be described, by way of example only, with reference to the accompanying drawings.

Figure 1:
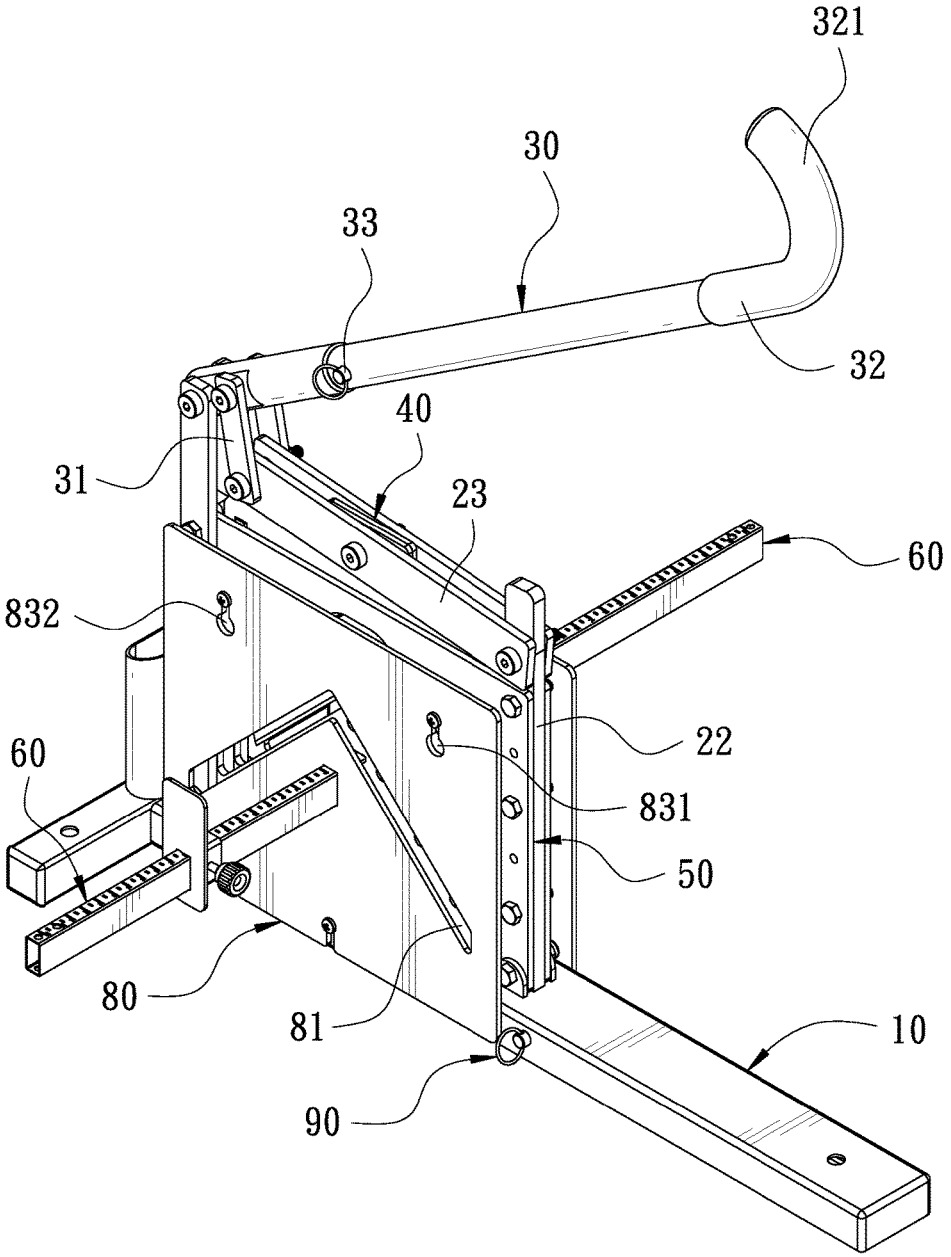
FIG. 1 is a perspective view t of the present invention.
Figure 2:
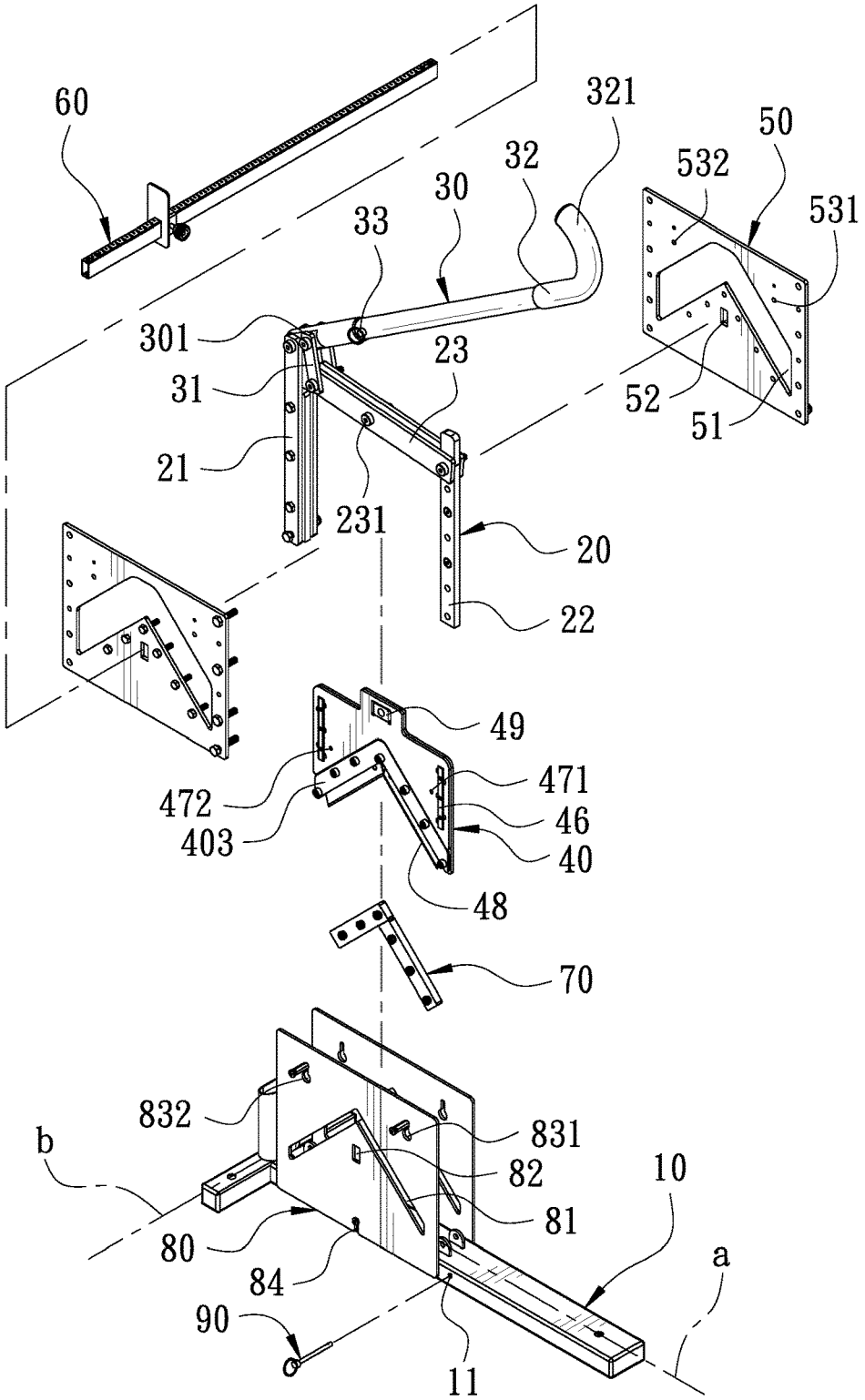
FIG. 2 is an exploded view of the present invention.
Figure 3:
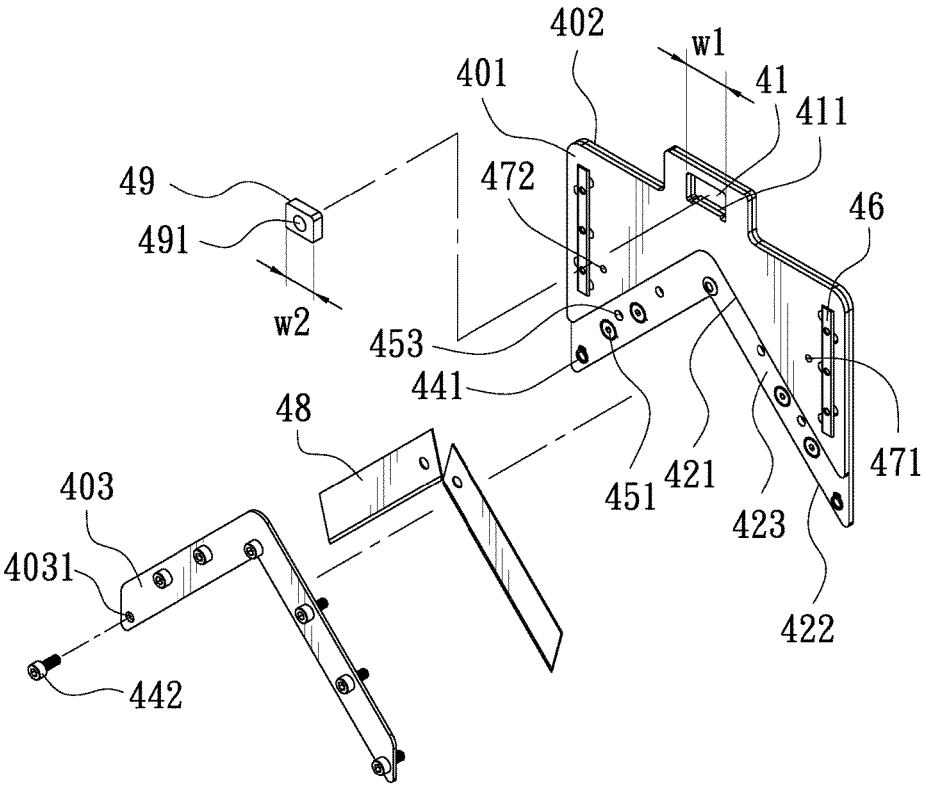
FIG. 3 is an exploded view of the blade holder of the present invention.
Figure 4:
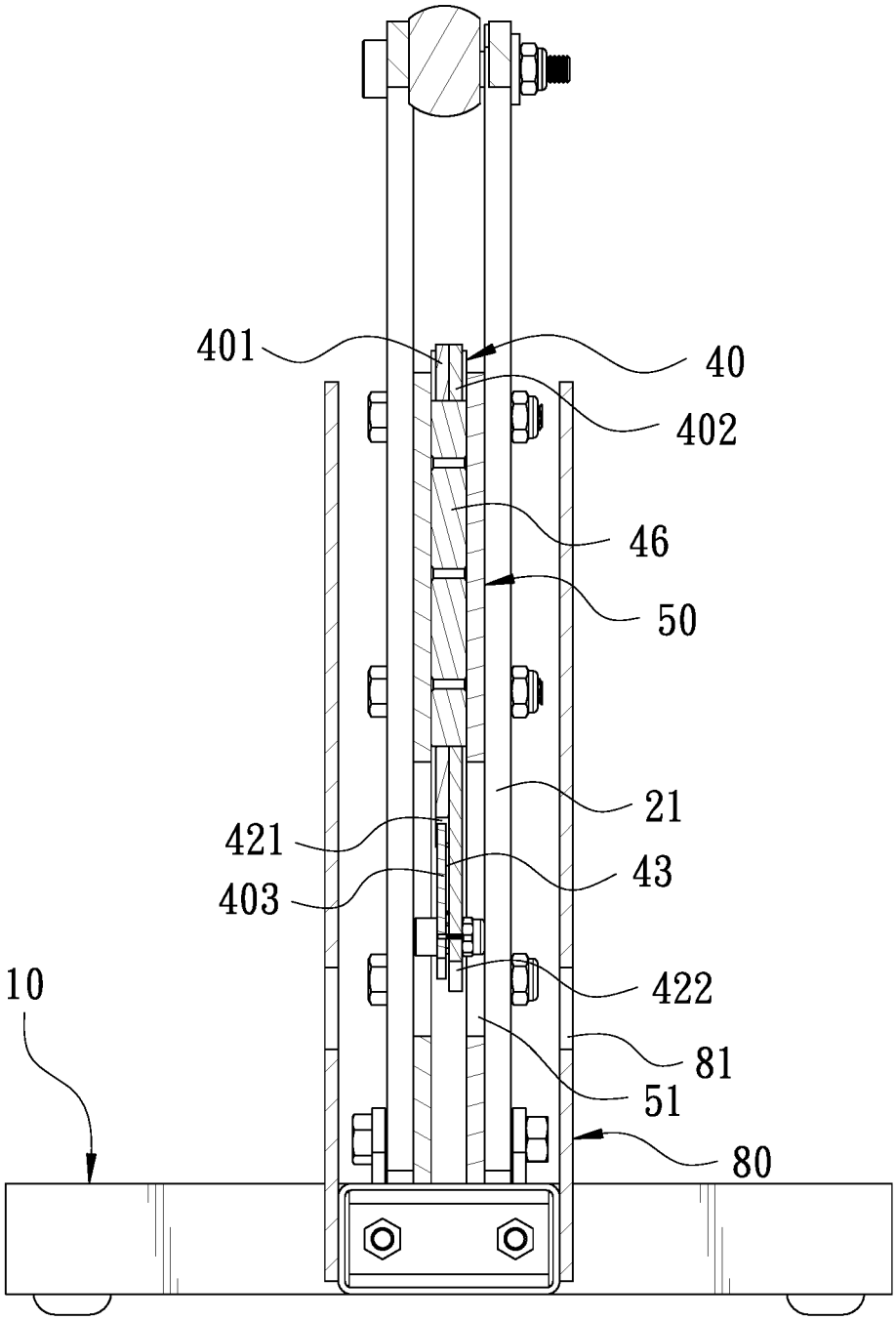
FIG. 4 is a sectional view of the present invention.

FIG. 1 is a perspective view t of the present invention. FIG. 2 is an exploded view of the present invention. FIG. 3 is an exploded view of the blade holder of the present invention. FIG. 4 is a sectional view of the present invention. The present invention discloses a paper corner protector cutter. The paper corner protector cutter comprises a base 10, a frame 20, a handle 30, a blade holder 40, at least one blade 48, two stop plates 50, at least one chopping board 70, and two covering plates 80.

The base 10 is a rectangular base and defines a long axis a and a short axis b. The base 10 is provided with a working insertion hole 11 in the direction of the short axis b for insertion of a fixing pin 90.

The frame 20 is erectly disposed on the base 10. The frame 20 comprises a first erect frame 21 and a second erect frame 22 which are spaced and disposed along the long axis a. The second erect frame 22 is pivotally connected with an operation rod 23. The operation rod 23 extends towards the first erect frame 21 to form a free end. The operation rod 23 is pivotally connected with a drive shaft 231 in the direction of the short axis b.

The handle 30 comprises a pivot rod 301 which is pivotally connected to the first erect frame 21. The handle 30 is pivotally connected with a connecting rod 31 located close to the pivot rod 301. Another end of the connecting rod 31 is pivotally connected to the free end of the operation rod 23. The handle 30 is further connected with a handle portion 32 through a fixing pin 33. The handle portion 32 is bent upwards to form a bent portion 321, such that the handle portion 32 has a J-shaped cross-section.

Figure 5:
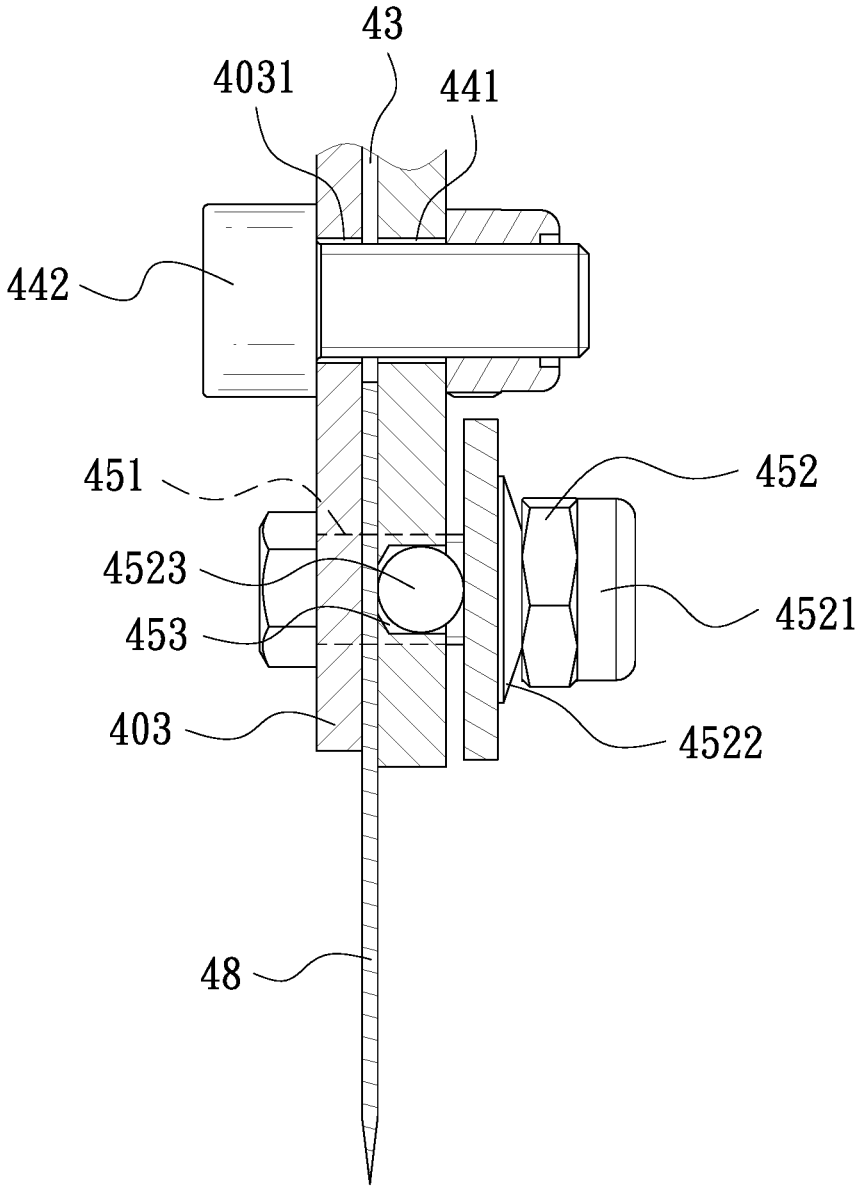
FIG. 5 is a partial enlarged sectional view of the present invention.
Figure 7:
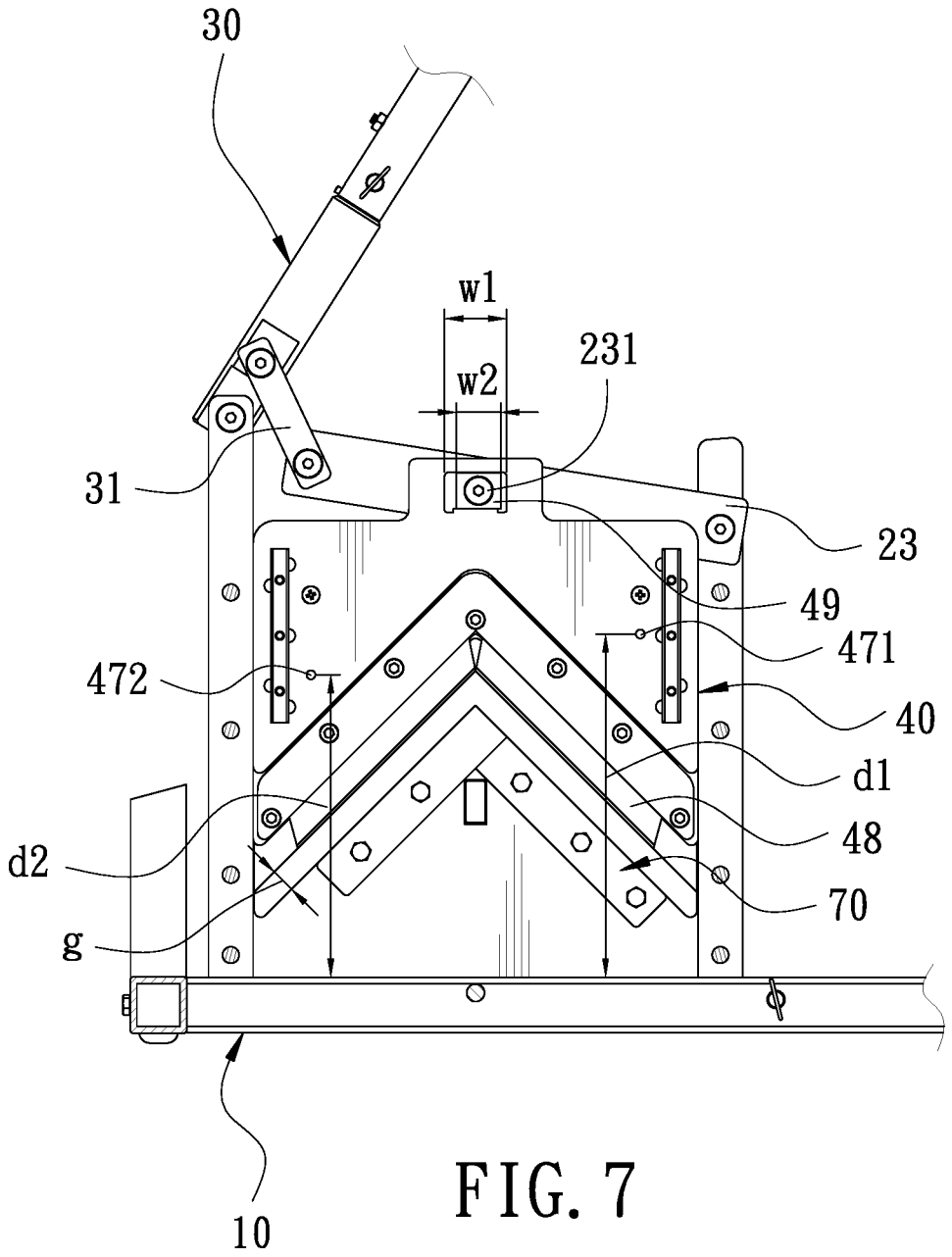
FIG. 7 is a schematic view of the present invention when in use, showing that the blade holder is lifted.
Figure 8:
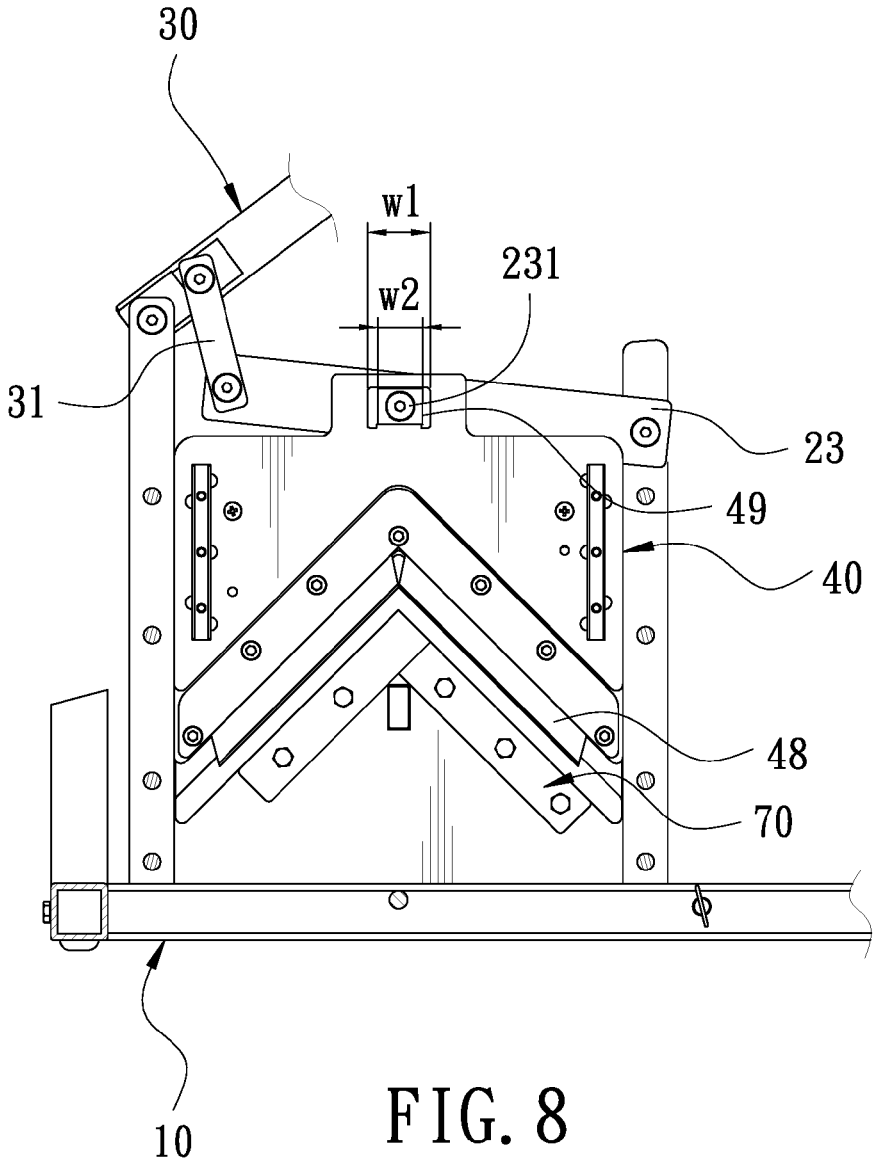
FIG. 8 is a schematic view of the present invention when in use, showing that the paper corner protector is inserted.
Figure 9:
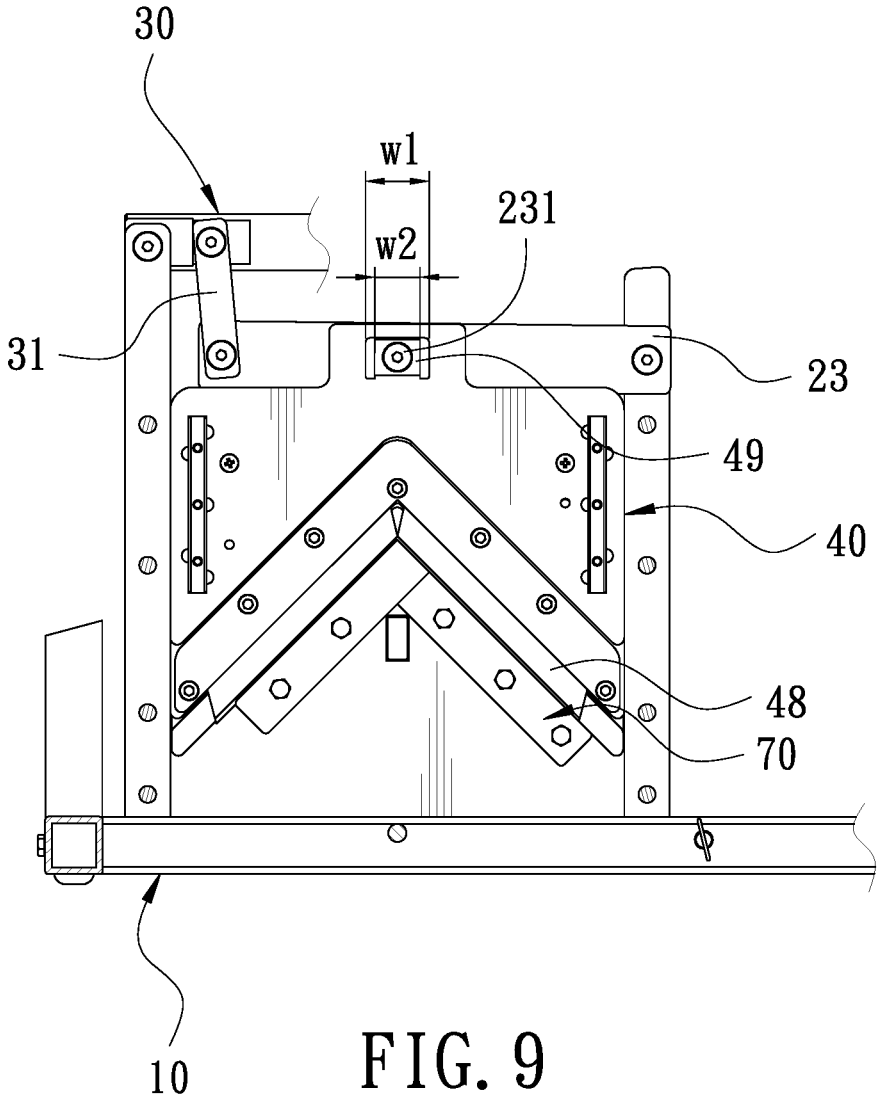
FIG. 9 is a schematic view of the present invention when in use, showing that the paper corner protector is cut.

The blade holder 40 is disposed between the first erect frame 21 and the second erect frame 22. The blade holder 40 comprises a first plate 401 and a second plate 402. A top end of each of the first plate 401 and the second plate 402 is formed with an opening 41. A central portion of a bottom side of the opening 41 of each of the first plate 401 and the second plate 402 is provided with a flange 411. A drive block 49 is provided in the openings 41 of the first plate 401 and the second plate 402. The opening 41 and the drive block 49 each have a rectangular shape. The drive block 49 has a through hole 491. The drive shaft 231 is inserted through the through hole 491 of the drive block 49, such that the blade holder 40 is connected with the drive block 49 through the opening 41 and the operation rod 23 is pivotally connected with the drive block 49 through the drive shaft 231. The opening 41 defines a first width w1 in the direction of the long axis a. The drive block 49 defines a second width w2 in the direction of the long axis a. The first width w1 is greater than the second width w2. The drive block 49 is slightly against the bottom side of the opening 41 and the flange 411, enabling the drive block 49 to slide within the opening 41 in the direction of the long axis a. In the present invention, a bottom end of the first plate 401 is formed with a first reverse V-shaped recess 421, and a bottom end of the second plate 402 is formed with a second reverse V-shaped recess 422. The first reverse V-shaped recess 421 is greater than the second reverse V-shaped recess 422. When the first plate 401 and the second plate 402 are disposed side-by-side, a reverse V-shaped space 423 is formed. The blade holder 40 is provided with a reverse V-shaped board 403 in the reverse V-shaped space 423. A blade room 43 is formed between the reverse V-shaped board 403 and the second plate 402. Referring to FIG. 5, the second plate 402 is formed with a plurality of first locking holes 441, second locking holes 451, and steel ball accommodation rooms 453 along a circumferential portion of the second reverse V-shaped recess 422. The second locking holes 451 are disposed close to the steel ball accommodation rooms 453. The reverse V-shaped board 403 is formed with a plurality of third locking holes 4031 corresponding to the first locking holes 441. First screw members 442 are inserted through the first locking holes 441 and the third locking holes 4031 to lock the second plate 402 and the reverse V-shaped board 403. Each of the second locking holes 451 is screwedly provided with a tightening member 452. In the present invention, the fastening member 452 comprises a second screw member 4521. A disk-shaped elastic plate 4522 is fitted on the second screw member 4521. When the second screw member 4521 is screwed, the disk-shaped elastic plate 4522 is pushed to lean against a steel ball 4523 in the steel ball accommodation room 453, enabling the steel ball 4523 to have a prestressing force towards the blade room 43. Outer sides of the first plate 401 and the second plate 402 are longitudinally provided with guide rails 46. The first plate 401 and the second plate 402 are provided with a first positioning hole 471 and a second positioning hole 472, respectively. Referring to FIG. 7, a first distance d1 is defined from the first positioning hole 471 to the base 10, and a second distance d2 is defined from the second positioning hole 472 to the base 10. The first distance d1 is greater than the second distance d2.

The blade 48 is inserted in the blade room 43. The blade 48 is clamped between the steel ball 4523 of the tightening member 452 and the reverse V-shaped board 403. In the present invention, two blades 48 are inserted along two sides of the reverse V-shaped board 403. The blades 48 are existing cutter blades.

The two stop plates 50 are disposed at two sides of the frame 20, enabling the blade holder 40 to be located between the stop plates 50 and the guide rails 46 to be in contact with the stop plates 50, which is beneficial for the blade holder 40 to slide between the stop plates 50. The stop plates 50 each have a first reverse V-shaped opening 51 corresponding to the reverse V-shaped board 403 of the blade holder 40 and the blades 48, enabling the reverse V-shaped board 403 of the blade holder 40 and the blades 48 to be exposed out of the first reverse V-shaped opening 51. The stop plates 50 each have a first insertion hole 52 close to a circumferential edge of the first reverse V-shaped opening 51 for insertion of a measuring ruler 60. The stop plates 50 each have a first through hole 531 and a second through hole 532 corresponding to the first positioning hole 471 and the second positioning hole 472 of the blade holder 40, respectively. The first distance d1 is defined from the first through hole 531 as well as the second through hole 532 to the base 10.

The chopping board 70 is fixed to the bottom sides of the first reverse V-shaped openings 51 of the stop plates 50. Referring to FIG. 7, the chopping board 70 and the blade 48 are spaced to form a gap g when the blade holder 40 is lifted.

The two covering plates 80 are erectly disposed at the two sides of the base 10 corresponding to the stop plates 50. The stop plates 50 are screwedly locked to the covering plates 80, respectively. The covering plates 80 each have a second reverse V-shaped opening 81 corresponding to the first reverse V-shaped openings 51 of the stop plates 50. The covering plates 80 each have a second insertion hole 82 corresponding to the first insertion hole 52 for insertion of the measuring ruler 60. The covering plates 80 each have a first retaining hole 831 and a second retaining hole 832 corresponding to the first through hole 531 and the second through hole 532 of each stop plate 50. The fixing pin 90 is selectively inserted through the first retaining hole 831 and the first through hole 531 to the first positioning hole 471, or the fixing pin 90 is selectively inserted through the second retaining hole 832 and the second through hole 532 to the second positioning hole 472. The first retaining hole 831 and the second retaining hole 832 are calabash-shaped holes. The stop plates 50 are screwedly locked to the covering plates 80 through the top ends of the first retaining hole 831 and the second retaining hole 832. The bottom ends of the first retaining hole 831 and the second retaining hole 832 are exposed out of the first through hole 531 and the second through hole 532, respectively. The covering plates 80 each have a notch 84 relative to the base 10. The covering plates 80 are screwedly locked to the base 10 through the first through hole 531, the second through hole 532, and the notch 84.

Figure 13:
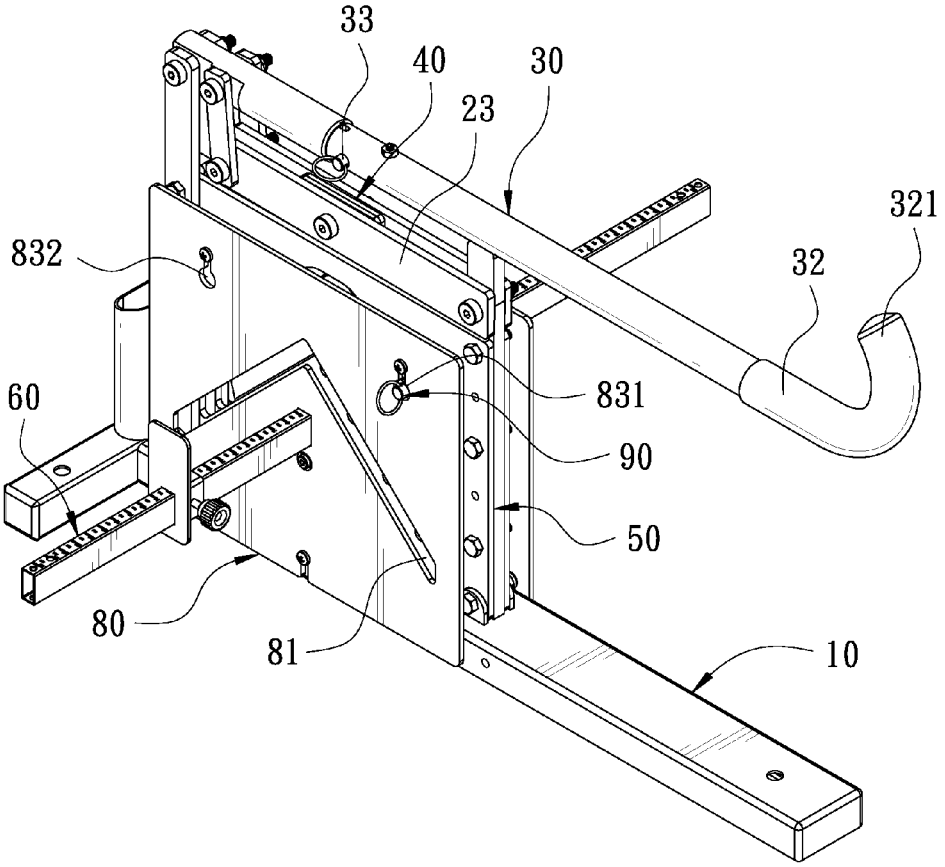
FIG. 13 is a schematic view of the present invention when in use, showing that the handle is retained.

Referring to FIG. 6 through FIG. 9 in cooperation with FIG. 13, FIG. 1, and FIG. 2, the fixing pin 90 is first pulled out and inserted into the working insertion hole 11. The user can operate the paper corner protector cutter through the handle 30. The connecting rod 31 is lifted by operating the handle 30 to move the operation rod 23 up. Through the drive shaft 231, the operation rod 23 brings the drive block 49 to lift the blade holder 40 and the blade 48. When the gap g between the blade 48 of the blade holder 40 and the chopping board 70 is exposed out of the first reverse V-shaped opening 51 and the second reverse V-shaped opening 81, the user can insert the paper corner protector into the second reverse V-shaped opening 81 to cut the paper corner protector for a desired length by means of the measuring rule 60. Finally, the handle 30 is pressed downward again to link the operation rod 23 and the blade holder 40 downward. Thereby, the paper corner protector is cut by the blade 48, enabling the paper corner protector to be cut for the demand of various protects and applied to protect packing.

Referring to FIG. 3, through the technical features that the drive block 49 is pivotally connected to the drive shaft 231 of the operation rod 23 through the through hole 491; the first width w1 of the opening 41 is greater than the second width w2 of the drive block 49; and the drive block 49 is slightly against the bottom side of the opening 41 and the flange 411, the drive block 49 is able to slide eccentrically and transversely within the opening 41 and the handle 30 can be lifted longitudinally or down to press the blade holder 40 to keep the speed and precision for cutting the paper corner protector.

The outer sides of the first plate 401 and the second plate 402 are longitudinally provided with the guide rails 46, enabling the stop plates 50 to hold against the first plate 401 and the second plate 402 inwards so as to keep the structural strength of the paper corner protector cutter. When the blade holder 40 is lifted or pressed down, the guide rails 46 are adapted to decrease the friction area between the stop plates 50 and the first plate 401 as well as the second plate 402, enhancing the utility of the paper corner protector cutter.

Figure 6:
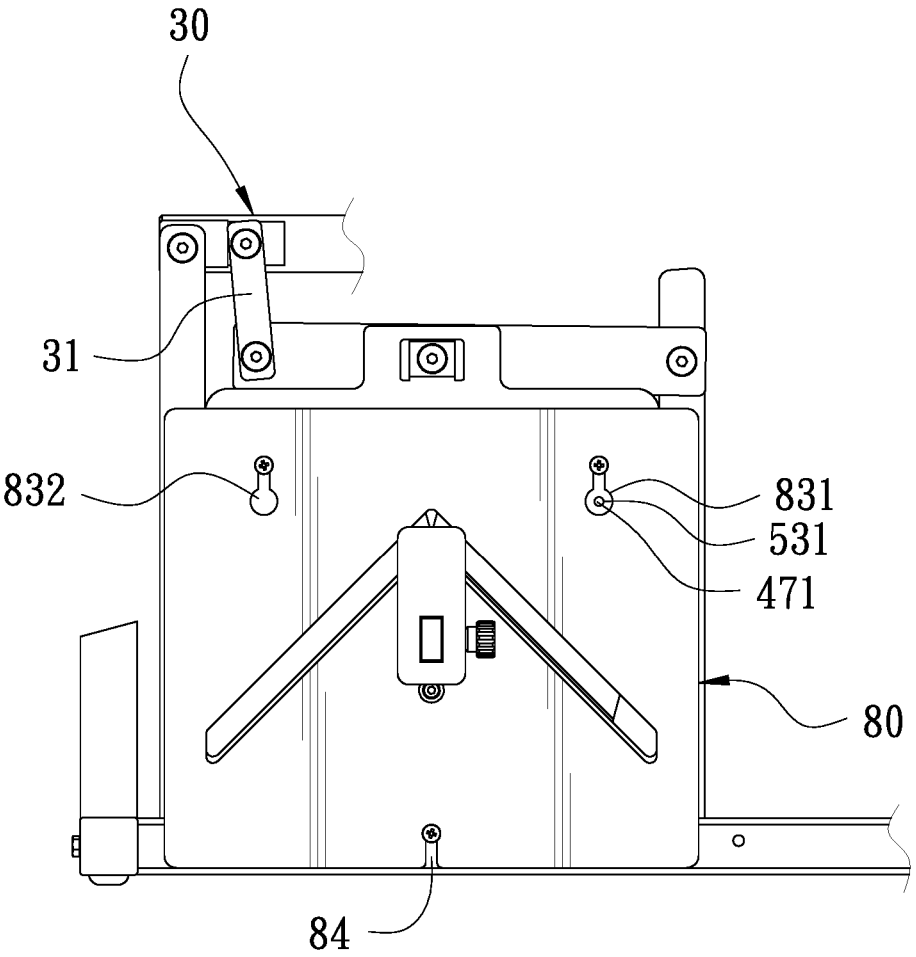
FIG. 6 is a schematic view of the present invention, showing that the fixing pin is pulled out.

Referring to FIG. 6 and FIG. 13, when the handle 30 is pressed down, the first positioning hole 471, the first through hole 531, and the first retaining hole 831 are arranged concentrically, and the fixing pin 90 is inserted therein to secure the blade holder 40 for carrying and transporting the present invention conveniently through the handle 30.

Figure 12:
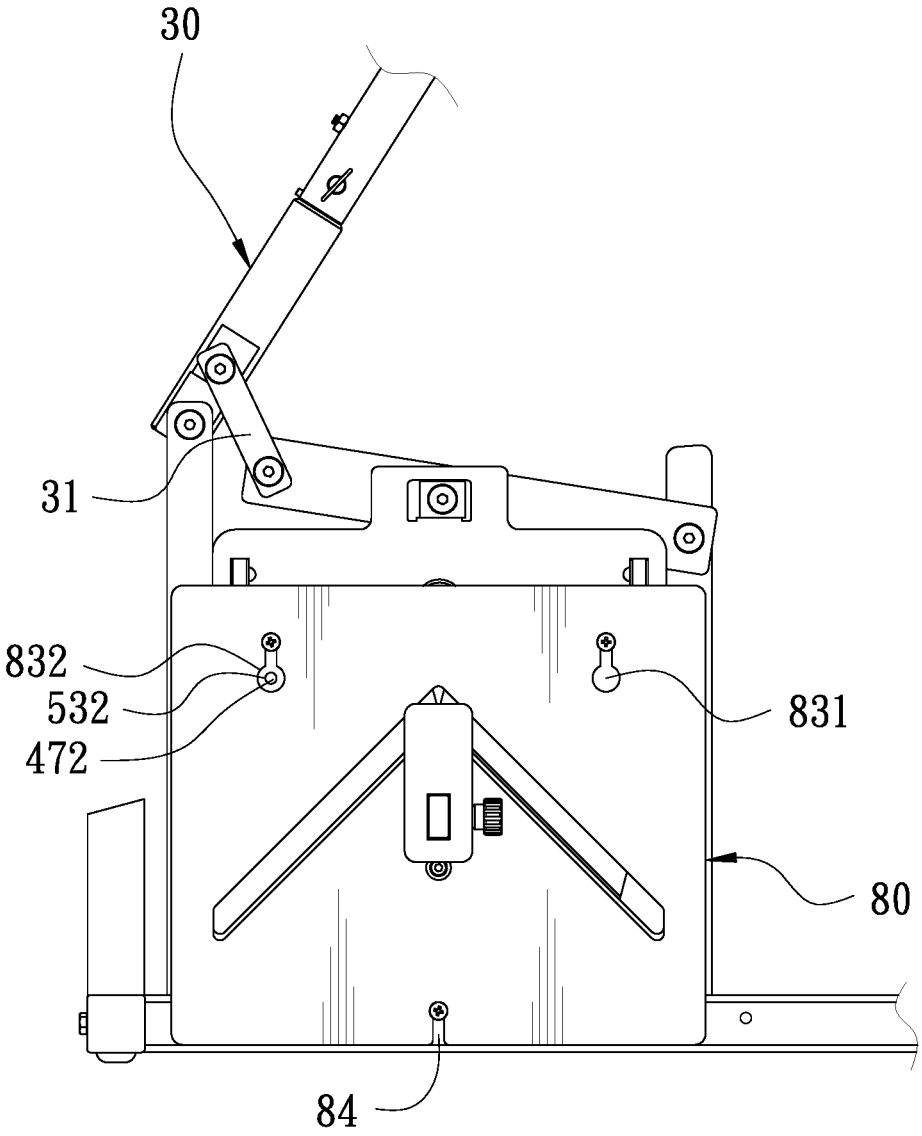
FIG. 12 is a schematic view of the present invention when in use, showing that the blade holder is retained.

Referring to FIG. 5 and FIG. 12 in cooperation with FIG. 2, when the user wants to replace the blade 48, the covering plates 80 are lifted to disengage from the base 10 and the stop plates 50 through the insertion hole 83 and the notch 84, such that the covering plates 80 are disassembled and the handle 30 is lifted for the second positioning hole 472, the second through hole 532, and the second retaining hole 832 to be arranged concentrically, the fixing pin 90 is inserted therein to position the blade holder 40 to be exposed out of the gap. At this time, the second screw member 4521 is loosened to release the disk-shaped elastic plate 4522 to decrease the prestressing force of the steel balls 4523 towards the blade 48. The blade 48 is elastically positioned in the blade room 43 through the first screw member 442 and the tightening member 452 for the user to pull out the blade 48 easily and replace a new one. The new blade is elastically positioned in the blade room 43 for the user to adjust the position of the blade 48. Finally, the second screw member 4521 is screwed to tighten the disk-shaped elastic plate 4522 for pushing the steel ball 4523 to hold against the blade 48 so as to secure the blade 48. The blade 48 can be replaced quickly.

Figure 10:
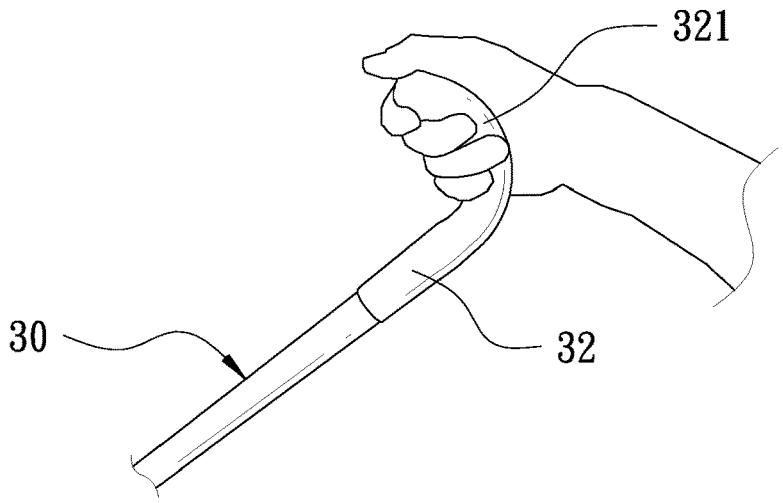
FIG. 10 is a schematic view of the present invention when in use, showing that the handle is grasped by the user.
Figure 11:
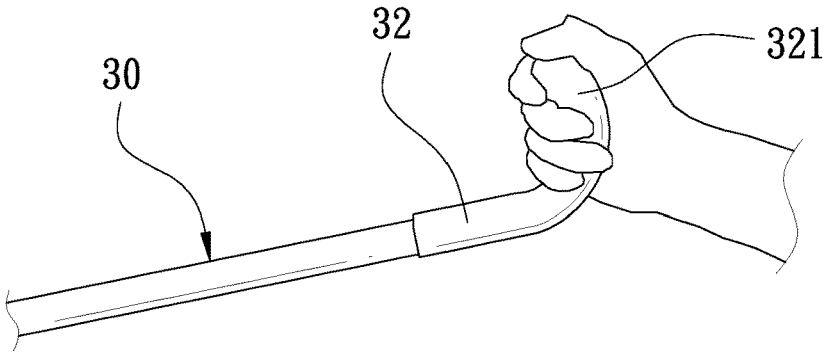
FIG. 11 is another schematic view of the present invention when in use, showing that the handle is grasped by the user.

Referring to FIG. 10 and FIG. 11, the distal end of the handle 30 is provided with the J-shaped handle portion 32, so that the user can grasp the handle portion 32 easily and smoothly to apply a force for operation. The handle portion 32 can be disassembled by dismantling the fixing pin 33 to reduce the size of the paper corner protector cutter for transportation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A paper corner protector cutter comprising:

a base;

a frame, the frame being disposed on the base, the frame comprising a first erect frame and a second erect frame which are spaced, the frame comprising an operation rod, the second erect frame and the operation rod being pivotally connected with each other, the operation rod being pivotally connected with a drive shaft;

a handle, the handle being pivotally connected to the first erect frame, the handle comprising a connecting rod, the connecting rod being pivotally connected to the operation rod;

a blade holder, the blade holder being disposed between the first erect frame and the second erect frame, the blade holder comprising a first plate and a second plate, a top end of each of the first plate and the second plate being formed with an opening, a drive block being provided in the openings of the first plate and the second plate, the drive block having a through hole, the drive shaft being inserted through the through hole of the drive block, the blade holder being connected with the drive block through the opening, the operation rod being pivotally connected with the drive block through the drive shaft, a bottom end of the first plate being formed with a first reverse V-shaped recess, a bottom end of the second plate being formed with a second reverse V-shaped recess, the blade holder having a blade room formed between the first reverse V-shaped recess and the second reverse V-shaped recess;

at least one blade, the blade being inserted in the blade room;

two stop plates, the two stop plates being disposed at two sides of the frame, enabling the blade holder to be located between the stop plates, the stop plates each having a first reverse V-shaped opening corresponding to the blade holder; and at least one chopping board, the chopping board being fixedly connected to the stop plates.

2. The paper corner protector cutter as claimed in claim 1, wherein the first plate and the second plate are disposed side-by-side to form a reverse V-shaped space in between the first reverse V-shaped recess and the second reverse V-shaped recess, the blade holder is provided with a reverse V-shaped board in the reverse V-shaped space, and the blade room is formed between the reverse V-shaped board and the second plate.

3. The paper corner protector cutter as claimed in claim 1, further comprising two covering plates, the covering plates being erectly disposed at two sides of the base corresponding to the stop plates, the covering plates each having a second reverse V-shaped opening corresponding to the first reverse V-shaped openings of the stop plates.

4. The paper corner protector cutter as claimed in claim 1, wherein the second plate is formed with a plurality of first locking holes along a circumferential portion of the second reverse V-shaped recess, the reverse V-shaped board is formed with a plurality of third locking holes corresponding to the first locking holes, and first screw members are inserted through the first locking holes and the third locking holes.

5. The paper corner protector cutter as claimed in claim 1, wherein the second plate is formed with a plurality of second locking holes and steel ball accommodation rooms along a circumferential portion of the second reverse V-shaped recess, the second locking holes are disposed close to the steel ball accommodation rooms, each of the second locking holes is screwedly engaged with a tightening member, the tightening member comprises a second screw member, a disk-shaped elastic plate is fitted on the second screw member, the disk-shaped elastic plate is adapted to press a steel ball in the steel ball accommodation rooms, and the steel ball is biased by the disk-shaped plate to hold against the blade.

6. The paper corner protector cutter as claimed in claim 1, wherein the blade holder is longitudinally provided with guide rails, and the guide rails are in contact with the stop plates.

7. The paper corner protector cutter as claimed in claim 1, wherein the stop plates each have a first insertion hole close to a circumferential edge of the first reverse V-shaped opening for insertion of a measuring ruler.

8. The paper corner protector cutter as claimed in claim 1, wherein the first plate and the second plate are provided with a first positioning hole and a second positioning hole respectively, a first distance is defined from the first positioning hole to the base, a second distance is defined from the second positioning hole to the base, the first distance is greater than the second distance, the stop plates each have a first through hole and a second through hole corresponding to the first positioning hole and the second positioning hole of the blade holder respectively, and the first distance is defined from the first through hole as well as the second through hole to the base.

9. The paper corner protector cutter as claimed in claim 1, wherein the handle is further connected with a handle portion, the handle portion is bent upwards to form a bent portion, and the handle portion has a J-shaped cross-section.

10. The paper corner protector cutter as claimed in claim 1, wherein the opening and the drive block each have a rectangular shape, the opening defines a first width, the drive block defines a second width, the first width is greater than the second width, a central portion of a bottom side of the opening is provided with a flange, and the drive block is slightly against the bottom side of the opening and the flange.

* * * * *